US005951326A

United States Patent [19]

Okabe et al.

[11] Patent Number: 5,951,326

[45] Date of Patent: Sep. 14, 1999

[54] CONNECTOR AND CONNECTOR ASSEMBLING METHOD

[75] Inventors: Toshiaki Okabe; Akira Maeda, both of Shizuoka, Japan

[73] Assignee: Yazaki Corporation, Tokyo, Japan

[21] Appl. No.: 09/035,010

[22] Filed: Mar. 5, 1998

[30] Foreign Application Priority Data

Mar. 6, 1997 [JP] Japan ..... 9-051989
May 9, 1997 [JP] Japan ..... 9-119760

[51] Int. Cl.[6] ..... H01R 13/40

[52] U.S. Cl. ..... 439/596; 439/701

[58] Field of Search ..... 439/596, 752, 439/701

[56] References Cited

U.S. PATENT DOCUMENTS 5,664,967 9/1997 Hatagishi et al. ..... 439/596
5,700,163 12/1997 Okabe ..... 439/701
5,716,235 2/1998 Endo et al. ..... 439/596
5,779,506 7/1998 Okabe et al. ..... 439/752

FOREIGN PATENT DOCUMENTS 48-578 1/1973 Japan .
2-115252 9/1990 Japan .

*Primary Examiner*—Gary Paumen
*Attorney, Agent, or Firm*—Sughrue, Mion, Zinn, Macpeak & Seas, PLLC

[57] ABSTRACT

There is disclosed a connector in which contact portions of terminals, exposed to the exterior of a housing, can be protected. A pair of covers are disposed at one end side of a body, and are interconnected by band portions. Contact portions of terminals, projecting from the one end side of the body, are surrounded by the pair of covers and the band portions, and thus are protected.

14 Claims, 6 Drawing Sheets

CONNECTOR AND CONNECTOR ASSEMBLING METHOD

BACKGROUND OF THE INVENTION

This invention relates to a connector in which contact portions of terminals are projected outwardly from a housing, and also to a method of assembling this connector.

FIG. 1 shows a connector 1 similar to connectors disclosed in Japanese Utility Model Unexamined Publication Nos. Sho. 48-578 and Hei. 2-115252. This connector 1 includes a housing 3 having a plurality of terminal receiving chambers 2 formed therein, and a separate hood portion 4 fixedly attached to one end of the housing 3. Wire connection portions of terminals 5 are received respectively in the terminal receiving chambers 2 in the housing 3, and a contact portion 6 of each terminal 5 for connection to a mating terminal is projected outwardly from the housing 3. The hood portion 4, when attached to the one end of the housing 3, protects the contact portions 6 of the terminals 5 projected into the hood portion 4.

However, in a process of producing a wire harness, the housing 3 is connected to an end portion of the wire harness, and in this condition, when the wire harness is moved to be arranged, there is a possibility that an external force is applied to the contact portion 6 of the terminal 5, projecting from the housing 3, so that the contact portion 6 may be deformed. As a result, there is encountered a problem that the connector fails to be properly fitted in a mating connector.

SUMMARY OF THE INVENTION

It is therefore an object of this invention to provide a connector of the type in which contact portions of terminals, exposed to the exterior of a housing, can be protected, and another object is to provide a method of assembling this connector.

The above object has been achieved by a connector, according to a first aspect of the present invention, comprising terminals each having a wire connection portion for connection to an end of a wire and a contact portion for connection to a mating terminal, and a base housing receiving the terminals therein, the contact portions projecting outwardly from a body of the base housing; wherein the base housing includes the body, wire receiving grooves which are formed in stages in one end portion of the body, and receive the wire connection portions of the terminals, respectively, and a pair of covers which can close the uppermost-stage and lowermost-stage wire receiving grooves, and each having a supporting portion which is pivotally connected to the body so as to be pivotally moved from the other end side of the body to their closed position; and wherein the pair of covers are held at the other end portion of the body, and are interconnected by band portions, and the contact portions of the terminals, projecting from the body, are surrounded by the pair of covers and the band portions.

In this connector, before the base housing, having the contact portions of the terminals projecting outwardly from the body, is inserted, for example, into the case, the contact portions are surrounded by the pair of covers and the band portions interconnecting the covers, and therefore the terminals can be protected when the housing is handled during the installation of the wire harness.

In the above-mentioned construction, a housing case preferably includes a tubular receiving portion for receiving the body, and a hood portion for surrounding the contact portions projecting from the other end of the body.

In this connector, the body of the base housing is received in the tubular receiving portion, and the contact portions, projecting from the body, are surrounded by the hood portion, and are protected. In this case, the band portions are cut off, and the wire receiving grooves are closed by the pair of covers. In this condition, the contact portions of the terminals are projected from the body.

In the above-mentioned construction, there is more preferably provided a housing case which receives the base housing, and surrounds the contact portions.

In this connector, before the base housing, having the contact portions of the terminals projecting outwardly from the body, is inserted into the housing case, the contact portions are surrounded by the pair of covers and the band portions interconnecting the covers.

The above object has also been achieved by a connector, according to a second aspect of the present invention, comprising terminals each having a wire connection portion for connection to an end of a wire and a contact portion for connection to a mating terminal, and a plurality of base housings which are stacked together, and receive the terminals therein, the contact portions projecting outwardly from bodies of the base housing; wherein the base housing includes the body, a wire receiving groove which is formed in one end portion of the body, and receives the wire connection portions of the terminals, and a cover which can close the wire receiving groove, and is pivotally connected to the base housing so as to be pivotally moved from the other end portion of the body to its closed position; and wherein the contact portions, projecting from the body, is surrounded by the cover held at the other end portion of the body, a protection wall extending from the other end of the body, and band portions interconnecting the protection wall and the cover.

In this connector, the contact portions, projecting from the body of each base housing, are surrounded by the cover, the protection wall and the band portions, and therefore the terminals can be protected when the housing is handled during the installation of the wire harness.

In the above-mentioned construction of the connector according to the present invention, the band portions are preferably cut off, and the wire receiving grooves may be closed respectively by the covers, and in this condition the two base housings may be stacked together, with the wire receiving grooves facing each other, so that the protection walls of the two base housings are mated together.

In this connector, the band portions are cut off, and the wire receiving groove, receiving the terminals, is closed by the cover, and the two base housings are joined together, with the protection walls mated together. In this condition, the contact portions of the terminals are surrounded and protected by the protection walls mated together.

In the above-mentioned construction of the connector, preferably, the tubular portion is formed integrally on the protection wall of one of the two base housings, and when the protection walls are mated together, a hood portion is formed by the tubular portion and the two protection walls.

In this connector, the band portions are cut off, and the wire receiving groove, receiving the terminals, is closed by the cover, and the two base housings are joined together, with the protection walls mated together, thereby forming the hood portion. In this condition, the contact portions of the terminals are surrounded and protected by the hood portion.

In the above-mentioned construction, more preferably, the wire connection portion of the terminal comprises a press-connecting portion having press-connecting blades, and the end of the wire is press-fitted into a gap between the press-connecting blades of the terminal received in the wire receiving groove in the body.

By press-fitting the end of the wire into the press-connecting portion, the terminal is connected to the wire end. The press-connecting portion of the terminal is received in the terminal receiving groove in the base housing, and the contact portion for connection to the mating terminal is projected outwardly from the body of the base housing.

According to a third aspect of the present invention, there is provided a method of assembling a connector as defined in the first aspect of the present invention, wherein the pair of covers of the base housing are disposed at the other end portion of the body, and are interconnected by the band portions, thereby opening the wire receiving grooves, and in this condition each of the terminals are inserted into the base housing in such a manner that the wire connection portion is received in the wire receiving groove, with the contact portion projecting from the other end of the body, and subsequently the band portions are cut off, and the pair of covers are pivotally moved toward the one end of the body to close the wire receiving grooves, and in this condition the base housing is inserted into the housing case, so that the body is received in the tubular receiving portion, with the contact portions surrounded by the hood portion.

In this connector assembling method, before the base housing, having the contact portions of the terminals projecting outwardly from the body, is inserted into the housing case, the contact portions are surrounded by the pair of covers and the band portions, and therefore the contact portions can be protected when the base housing is handled.

According to a fourth aspect of the present invention, there is provided a method of assembling a connector as defined in the second aspect of the present invention, in which the cover of each of the base housings is disposed at the other end portion of the body, and are connected to the protection wall by the band portions, thereby opening the wire receiving groove, and in this condition the terminals are inserted into the corresponding base housing in such a manner that the wire connection portions are received in the wire receiving groove, with the contact portions projecting from the other end of the body, and in this condition the base housings are suitably moved, and subsequently the band portions are cut off, and the cover of each of the base housings is pivotally moved toward the one end of the body to close the wire receiving groove, and in this condition the base housings are stacked together, with the protection walls mated together.

In this connector assembling method, the contact portions, projecting from the body, are surrounded by the cover, the protection wall and the band portions. Even when the base housing is moved, for example, during the production of the wire harness, an external force will not be applied to the contact portions, and the contact portions are protected. The band portions are cut off, and the wire receiving groove is closed by the cover. The base housings are stacked together, with the protection walls mated together, and the contact portions are surrounded by these protection walls. Even when the connector is moved, for example, during the transport of the wire harness, an external force will not be applied to the contact portions, and the contact portions are protected.

In the invention of claim 10 according to claim 8 or claim 9, the wire connection portion of the terminal comprises a press-connecting portion having press-connecting blades, and the end of the wire is press-fitted into a gap between the press-connecting blades of the terminal received in the wire receiving groove in the body.

In this connector assembling method, by press-fitting the end of the wire into the press-connecting portion, the terminal is connected to the wire end. At this time, the contact portions are surrounded and protected by the cover, the protection wall and the band portions.

DESCRIPTION OF THE PREFERRED EMBODIMENTS OF THE INVENTION

Preferred embodiments of connectors of the invention, as well as a method of assembling these connectors will be described.

First Embodiment

Figure 3:
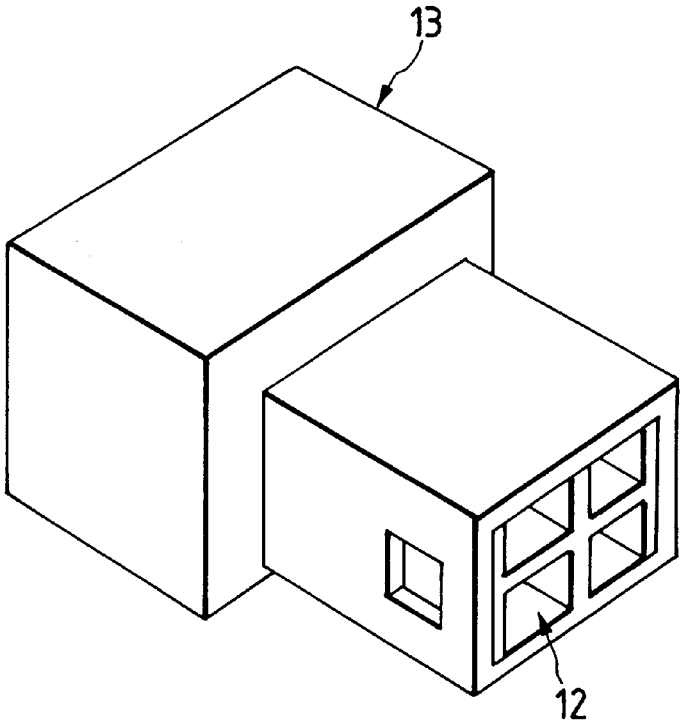
FIG. 3 is a perspective view showing a condition in which the base housing of the first embodiment is inserted in a housing case.
Figure 2A:
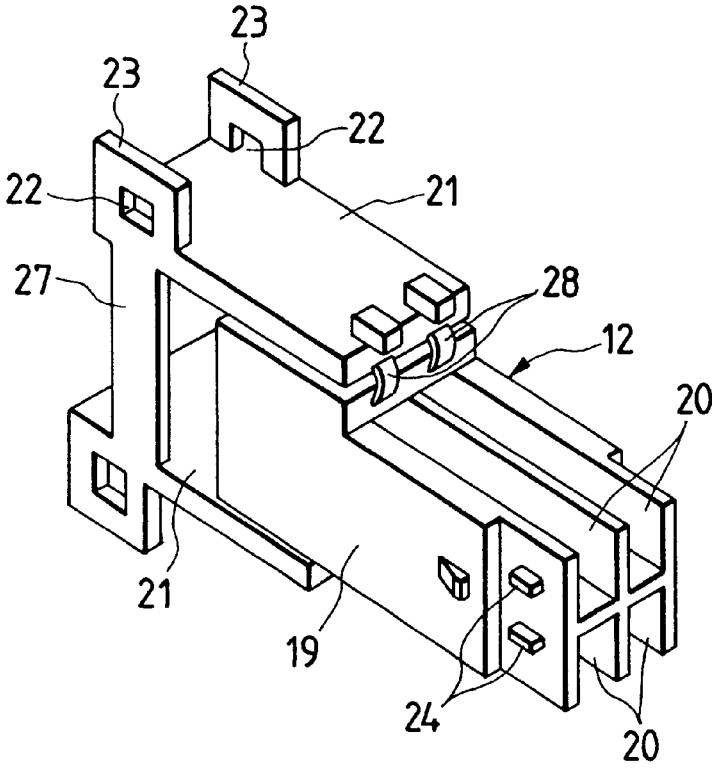
FIGS. 2(*a*) and 2(*b*) show a base housing of a first embodiment of a connector of the invention, FIG. 2(*a*) being a perspective view showing a condition in which a pair of covers are interconnected by band portions, and FIG. 2(*b*) being a perspective view showing a condition in which wire receiving grooves are closed by the covers.
Figure 2B:
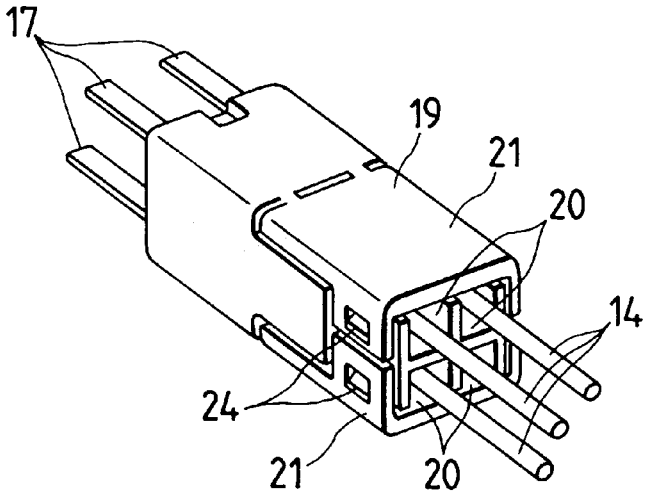
Figure 4:
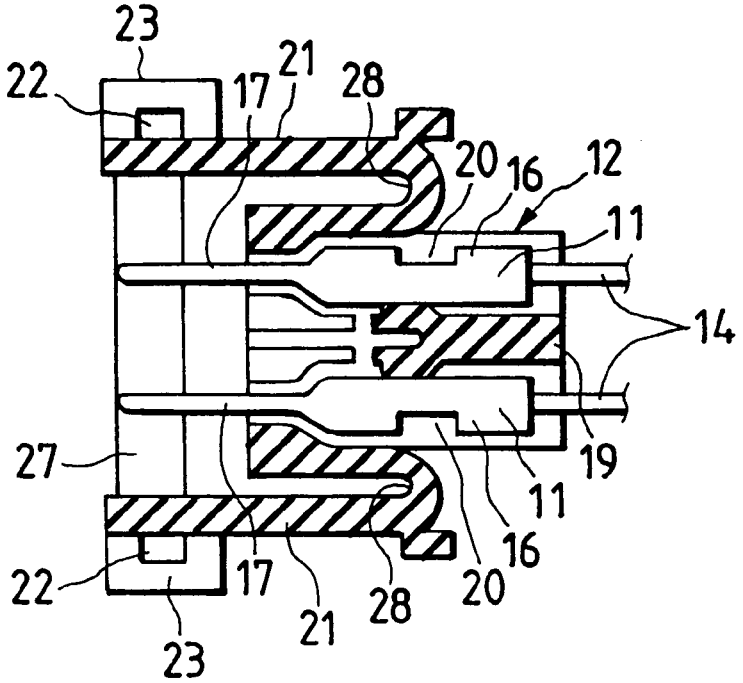
FIG. 4 is a cross-sectional view showing a condition in which the pair of covers of the first embodiment are interconnected by the band portions.
Figure 5:
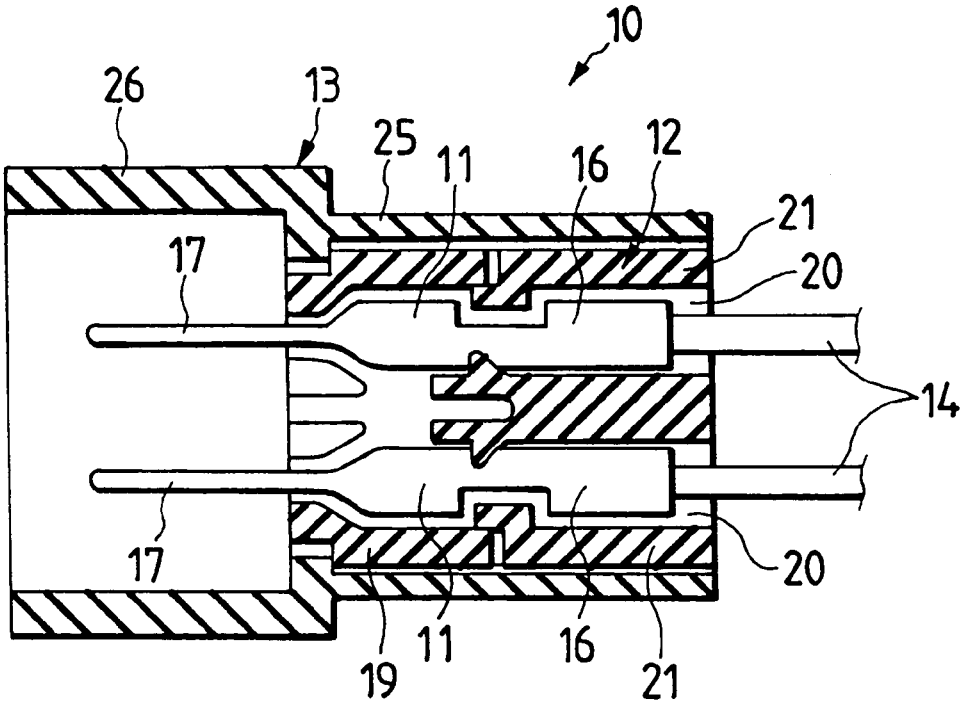
FIG. 5 is a cross-sectional view showing a condition in which the base housing of the first embodiment is inserted in the housing case.

FIG. 2 shows a base housing 12 of a connector 10, and FIG. 2(*a*) shows a condition in which contact portions 17 of terminals 11 are surrounded by a pair of covers 21 and 21 and band portions 27, and FIG. 2(*b*) shows a condition in which wire receiving grooves 20 are closed by the covers. FIG. 3 shows the overall configuration of the connector 10, and FIGS. 4 and 5 show the interior of the connector 10.

As shown in FIGS. 2 to 5, the connector 10 comprises the terminals 11, the base housing 12 holding the terminals 11 therein, and a housing case 13 receiving the base housing 12. A wire connection portion 16 (see FIGS. 4 and 4), to which an end of a wire 14 is connected, is formed at one end of the terminal 11, and the contact portion 17 for connection to a mating terminal is formed at the other end of the terminal 11. In this embodiment, the wire connection portion 16 of the terminal 11 comprises a press-connecting portion having a pair of press-connecting blades (not shown), and the end portion of the sheathed wire is press fitted into a gap between the pair of press-connecting blades, so that the wire 14 is connected to the terminal 11. This wire connection portion (hereinafter referred to as "press-connecting portion") 16 is received in the wire receiving groove 20 in the base housing 12.

Figure 1:
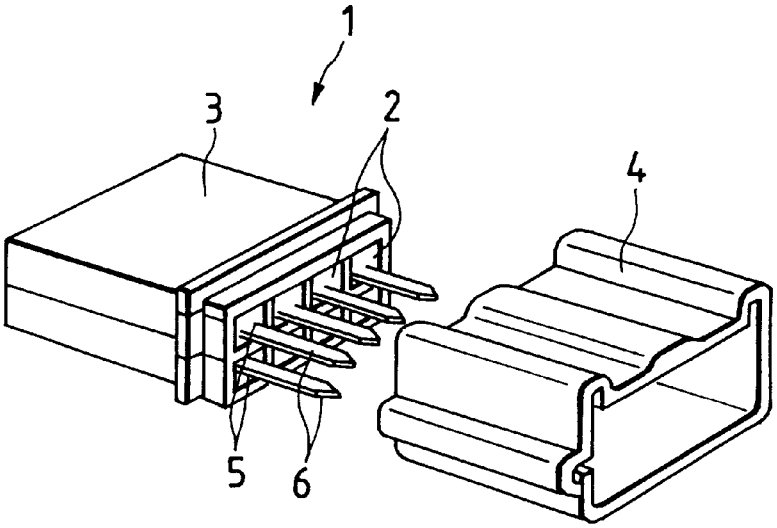
FIG. 1 PRIOR ART
FIG. 1 is a perspective view of a conventional connector.

As shown in FIGS. 1(*a*) and 1(*b*), the base housing 12 includes a body 19, wire receiving grooves 20 formed in stages in one end portion of the body 19 for respectively receiving the press-connecting portions 16 of the terminals 11, and the pair of covers 21 which can close the upper and lower stages of wire receiving grooves 20, respectively, and are pivotally connected to the body 19 through hinges 28 so as to be pivotally moved from the other end portion of the body 19 to their closed position.

Retaining frame portions 23 each having a retaining hole 22 are formed respectively on opposite sides of a distal end of each cover 21. Two pairs of retaining projections 24 are formed on the body 19, and each pair of retaining projections 24 are disposed respectively on opposite sides of the corresponding stage of wire receiving grooves 20. As shown in FIG. 1(*b*), when the wire receiving grooves 20 are closed by the covers 21, the retaining projections 24 are engaged respectively in the retaining holes 22. In this condition, the contact portions 17 of the terminals 11 are projected outwardly from the other end of the body 19 remote from the wire receiving grooves 20. The base housing 12, having the terminals 11 received therein, is inserted into the housing case 13.

As shown in FIGS. 3 and 4, the housing case 13 includes a tubular receiving portion 25 for receiving the body 19, and a hood portion 26 for surrounding or covering the contact portions 17 projecting outwardly from the other end of the body 19.

Before the base housing 12 is inserted into the housing case 13, the pair of covers 21 and 21 are disposed at the other end portion of the body 19 remote from the wire receiving grooves 20, and are interconnected by the band portions 27, as shown in FIG. 2(*a*). The band portions 27 may be formed integrally with the base housing 12 (in which case the band portions 27 have such a thickness that they can be easily cut off), or may be separate from the base housing 12, as an individual element. When the base housing 12 is to be inserted into the housing case 13, the band portions 27 are cut off, and the pair of covers 21 and 21 are turned to be disposed adjacent to the wire receiving grooves 20.

In any case, the base housing 12, having the terminals 11 received in the body 19, is held in the condition of FIG. 2(*a*) before the base housing 12 is inserted into the housing case 13.

A method of assembling the connector 10 will now be described.

When the base housing 12 is in the condition of FIG. 2(*a*), the pair of covers 21 and 21 are disposed at the other end portion of the body 19 remote from the wire receiving grooves 20, and are interconnected by the band portions 27 molded integrally with the covers 21 and 21. In this condition, the terminals 11 are inserted through the respective wire receiving grooves 20 into the base housing 20, so that the contact portions 17 are projected into a space formed by the pair of covers 21 and 21 and the band portions 27.

Then, the end portion of the sheathed wire 14 is placed on the press-connecting portion 16, and is press-connected to the press-connecting portion 16 by a press-connecting jig. In this manner, the base housing 12 is connected to the ends of the wires. The base housing 12 in this condition is handled in the process of producing a wire harness, and finally the base housing 12 is inserted into the housing case 13. At this time, the band portions 27 are cut off, and the pair of covers 21 and 21 are turned to cove the wire receiving grooves 20. Then, the contact portions 17 of the terminals 11 are received in the hood portion 26 of the housing case 13, and the body 19 is received in the tubular receiving portion 25.

In this embodiment, before the base housing 12 is inserted into the housing case 13, the contact portions 17 of the terminals 11, projecting outwardly from the body 19 of the base housing 12, are protected by the pair of covers 21 and 21 and the band portions 27, and therefore during the handling of the base housing 12, that is, in the process of the production of the wire harness, an external force will not be applied to the contact portions 17 of the terminals 11, and the contact portions 17 can be positively protected. As a result, the contact portions 17 can be properly fitted respectively into their mating terminals.

In this embodiment, although the wire connection portion 16 of the terminal 11 comprises the press-connecting portion having the press-connecting blades, the invention can be applied to the connector having other type of terminals to be connected respectively to the wires.

Second Embodiment

Figure 6:
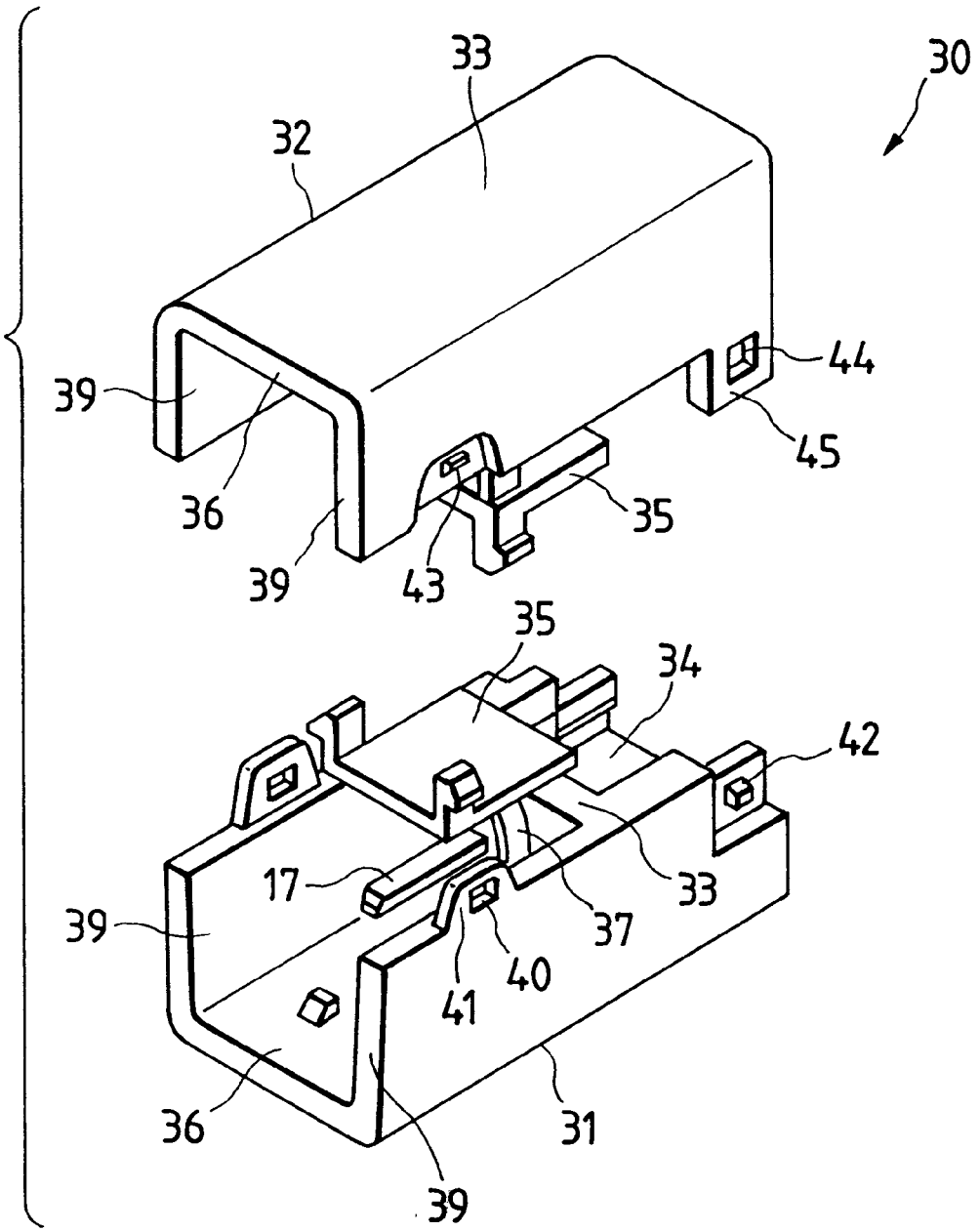
FIG. 6 is an exploded, perspective view of a second embodiment of a connector of the invention.
Figure 7:
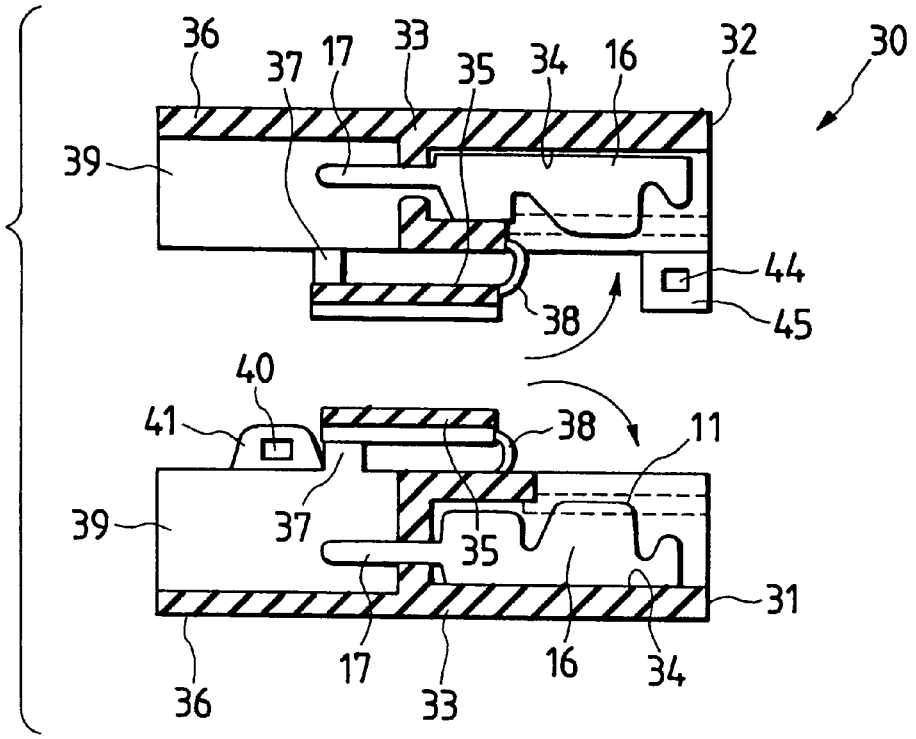
FIG. 7 is a cross-sectional view of the connector of the second embodiment.
Figure 8:
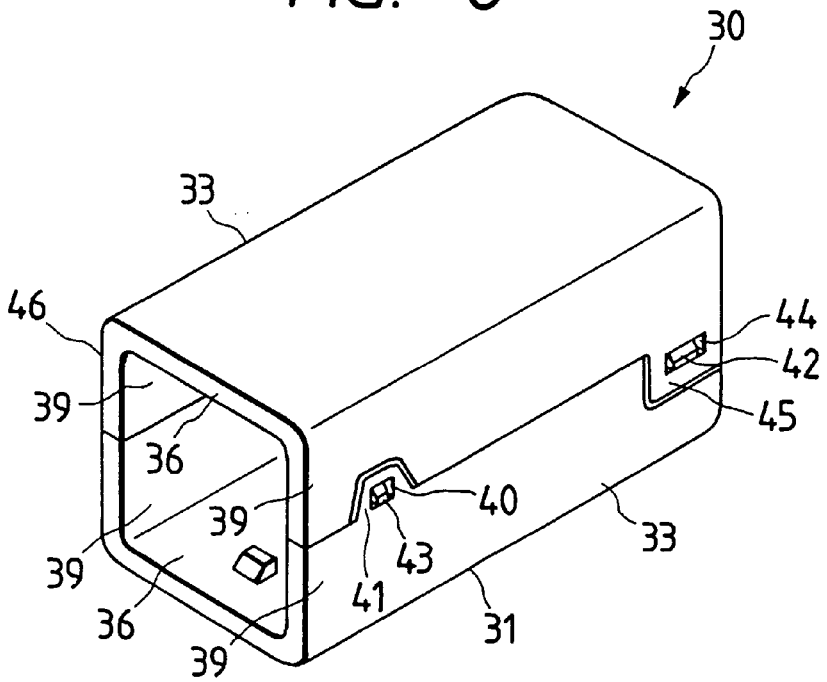
FIG. 8 is a perspective view of the connector of the second embodiment.

A second embodiment of a connector 30 of the invention will now be described with reference to FIGS. 6 to 8. FIG. 6 is an exploded, perspective view of the connector 30, FIG. 7 is a cross-sectional view, and FIG. 8 shows the connector 30 in its completely-assembled condition.

The connector 30 of this embodiment comprises terminals 11 each having a wire connection portion 16 for connection to an end of a wire, and a contact portion 17 for connection to a mating terminal, and two base housings 31 and 32 stacked together. The terminals 11 are received respectively in the base housings 31 and 32, and the contact portions 17 are projected outwardly.

The base housing 31 includes a body 33, a wire receiving groove 34 formed at one end portion of the body 33 for receiving a wire connection portion 16 of the terminal 11, and a cover 35 which can close the wire receiving groove 34, and is pivotally connected to the base housing 31 so as to be pivotally moved from the other end portion of the body 33 to its closed position. In this embodiment, the cover 35 held at the other end portion of the body 33, a protection wall 36 extending from the other end of the body 33, band portions 37, interconnecting the protection wall 36 and the cover 35, are formed integrally with one another. The cover 35 is molded integrally with the body 33 through a hinge 38 so as to be pivotally moved, and in this molded condition, the cover 35 is disposed at the other end portion of the body 33, and is connected to the protection wall 36 by the band portions 37. The band portions 37 are cut off, and then the cover 35 is pivotally moved toward the wire receiving groove 34 to close the wire receiving groove 34.

The protection wall 36 extends from the other end of the body 33, and has a U-shape which is open in the same direction as the wire receiving groove 34. Retaining frame portions 41 and 41 each having a retaining hole 40 are formed respectively on upper edges of opposite side walls 39 and 39 of the protection wall 36. Retaining projections 42 and 42 are formed respectively at the opposite sides of the wire receiving groove 34 at the rear end of the body 33.

The base housing 32 to be placed on the base housing 31 is basically similar in construction to the base housing 31, and the base housing 32 includes a body 33, a wire receiving groove 34, a cover 35 and a protection wall 36. Retaining projections 43 and 43 are formed respectively on opposite side walls of the protection wall 36 of the base housing 32, and retaining frame portions 45 and 45 each having a retaining hole 44 are formed on the body 33. When the base housing 32 is placed on the base housing 31, the retaining projections 43 and 43 are engaged respectively in the retaining holes 40 and 40, and also the retaining projections 42 and 42 on the base housing 31 are engaged respectively in the retaining holes 44 and 44.

When the base housings 31 and 32 are stacked together, the protection walls 36 and 36 are mated together to form a hood portion 46 of a rectangular cross-section. A mating connector (not shown) for connection to the connector 30 is inserted into this hood portion 46.

A method of assembling this connector 30 will now be described.

In the condition in which the band portions 37 are molded integrally with each of the base housings 31 and 33, the cover 35 is held at the other end portion of the body by the band portions 37, and is connected to the protection wall 36 by the band portions 37, as shown in FIG. 7. In this condition, the terminal 11 is inserted into the wire receiving groove 34 in the base housing 31, 32, and the wire connection portion 16 is received in the wire receiving groove 34, and the contact portion 17 is projected into a space formed by the protection wall 36, the cover 35 and the band portions 37 at the other side of the body 33. In this condition, the end portion of the wire is press-fitted into the wire connection portion 16 of the terminal 11 received in the base housing 31, 32, thereby connecting the terminal 11 to the wire end.

Then, the band portions 37 of the base housing 31, 32 are cut off, and the cover 35 is pivotally moved toward the wire receiving groove 34 to close the wire receiving groove 34. In this condition, the base housings 31 and 32 are opposed to each other in such a manner that the wire receiving grooves 34 and 34 face each other, and in this condition the base housings 31 and 32 are joined or stacked together, with the retaining projections 43 and 43 engaged respectively in the retaining holes 40 and 40 and with the retaining projections 42 and 42 engaged respectively in the retaining holes 44 and 44. As a result, the protection walls 36 and 36 are mated together to form the tubular hood portion 46 as shown in FIG. 8. The contact portions 17 and 17 of the terminals 11 and 11, projecting from the bodies 33 and 33 of the base housings 31 and 32, are projected into and surrounded by the tubular hood portion 46 formed by the protection walls 36 and 36, and therefore the contact portions 17 and 17 are positively protected.

In the connector 30 of this embodiment, in the condition in which the terminal 11 is received in the body 33 of the base housing 31, 32, the contact portion 17 is surrounded by the cover 35, the protection wall 36 and the band portions 37, and therefore even when the base housing is moved in this condition in a process of producing a wire harness, an external force will not be applied to the contact portion 17, and the contact portion 17 is positively protected.

When the base housings 31 and 32, each having the terminal 11 connected to the end of the wire, are stacked together, the contact portions 17 and 17 are surrounded by the protection walls 36 and 36, and therefore in this condition even when the connector is moved during the transport or at the time of mounting the wire harness to a vehicle, an external force will not be applied to the contact portions 17, and the contact portions 17 are positively protected.

In the connector of this embodiment, the base housings 31 and 32 have the protection walls 36 and 36, respectively, and when the base housings 31 and 32 are stacked together, the protection walls 36 and 36 are mated together to form the hood portion 46, and therefore it is not necessary to insert the base housings 31 and 32 into a hood portion of a separate housing case as in the conventional construction, and therefore the outer peripheral size of the connector can be reduced. As a result, the terminals can be arranged at a high density.

Third Embodiment

Figure 9:
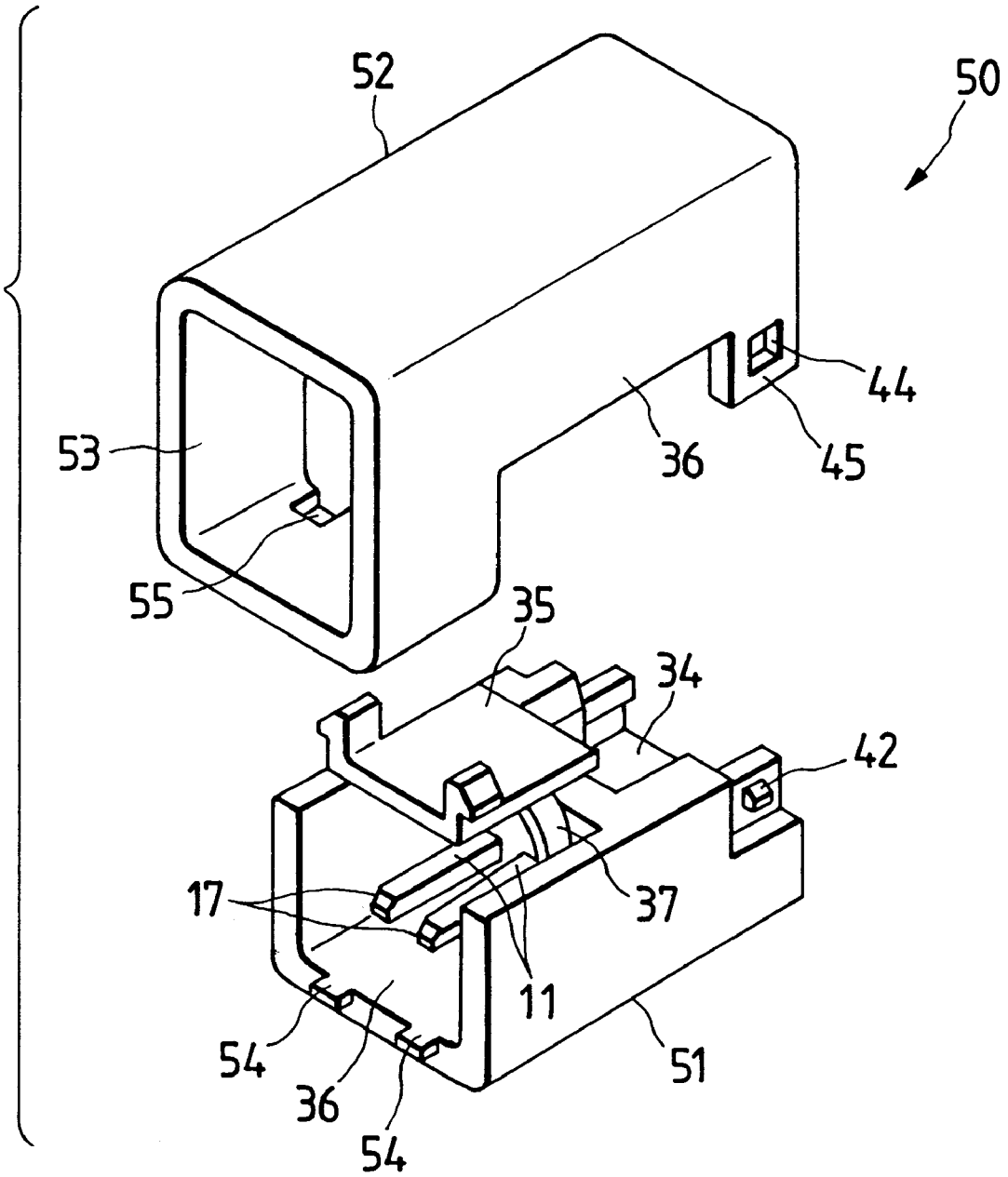
FIG. 9 is a perspective view of a third embodiment of a connector of the invention.

Next, a third embodiment of a connector 50 of the invention shown in FIG. 9 will now be de described. In this connector 50, a tubular hood portion 53 is formed integrally on a protection wall 36 of one of two base housings 51 and 52, and except this, the base housings 51 and 52 are similar in construction to the above-mentioned base housings 31 and 32.

As shown in FIG. 9, the lower base housing 51 has the same construction as that of the above-mentioned base housing 31 except that the length of extension of the protection wall 36 is different, and retaining projections 54 and 54 are formed on a distal end of the protection wall 36. The tubular portion 53 of a rectangular cross-section is formed on an outer end of the projection wall 36 of the upper base housing 52. Retaining grooves 55 are formed in an inner end of the tubular portion 53 adjacent to the protection wall 36.

When the base housings 51 and 52 are stacked together, the tubular portion 53 of the base housing 52 is connected to the distal end of the protection wall 36 of the base housing 51, and the hood portion is formed by the tubular portion 53 and the protection walls 36 and 36. The retaining projections 54 are engaged respectively in the retaining grooves 55, and retaining projections 42 are engaged respectively in retaining holes 44.

In the connector 50 of this embodiment, in the condition in which terminals 11 are received in the base housing 51, 52, contact portions 17 are surrounded by a cover 35, the protection wall 36 and band portions 37 as in the above embodiments, and an external force will not be applied to the contact portions 17, and the contact portions 17 are positively protected.

Wires are connected respectively to ends of the terminals 11, and wire receiving grooves 34 are closed respectively by the covers 35, and when the base housings 51 and 52 are stacked together, the contact portions 17 of the terminals 11 are projected into the hood portion defined by the tubular portion 53, and therefore are positively protected.

In this embodiment, the hood portion 53 is formed integrally on the base housing 52, and therefore it is not necessary to insert the two base housings 51 and 52 into a housing case having a hood portion. As a result, the outer peripheral size of the connector 50 will not be increased, and therefore the connector 50 can be formed into a small size, and since a larger amount of terminals can be received, the terminals can be arranged at a high density.

As described above, in the first aspect of the present invention, before the base housing, having the contact portions of the terminals projecting outwardly from the body, is inserted into the housing case, the contact portions are surrounded by the pair of covers and the band portions interconnecting the covers, and therefore the terminals can be protected when the housing is handled during the installation of the wire harness.

In the first aspect of the present invention, the body of the base housing is received in the tubular receiving portion, and the contact portions, projecting from the body, are surrounded by the hood portion, and are protected.

In the first aspect of the present invention, before the base housing is inserted into the housing case, the contact portions are surrounded by the pair of covers and the band portions interconnecting the covers, and therefore the terminals can be protected when the base housing is handled during the installation of the wire harness.

In the second aspect of the present invention, the contact portions, projecting from the body of each base housing, are surrounded by the cover, the protection wall and the band portions, and therefore the terminals can be protected when the housing is handled during the installation of the wire harness.

In the second aspect of the present invention, the band portions are cut off, and the wire receiving groove, receiving the terminals, is closed by the cover, and the two base housings are joined together, with the protection walls mated together. In this condition, the contact portions of the terminals are surrounded and protected by the protection walls mated together.

In the second aspect of the present invention, the band portions are cut off, and the wire receiving groove, receiving the terminals, is closed by the cover, and the two base housings are joined together, with the protection walls mated together, thereby forming the hood portion. In this condition, the contact portions of the terminals are surrounded and protected by the hood portion.

In the first or second aspects of the invention, by press-fitting the end of the wire into the press-connecting portion, the terminal is connected to the wire end. The press-connecting portion of the terminal is received in the terminal receiving groove in the base housing, and the contact portion for connection to the mating terminal is projected outwardly from the body of the base housing, and is protected by the protection wall, the cover and the band portions. When the two base housings are stacked together, the contact portions are protected by the partition walls.

In the third aspect of the present invention, before the base housing, having the contact portions of the terminals projecting outwardly from the body, is inserted into the housing case, the contact portions are surrounded by the pair of covers and the band portions, and therefore the contact portions can be protected when the base housing is handled.

In the fourth aspect of the present invention, the contact portions, projecting from the body, are surrounded by the cover, the protection wall and the band portions. Even when the base housing is moved, for example, during the production of the wire harness, an external force will not be applied to the contact portions, and the contact portions are protected.

The band portions are cut off, and the wire receiving groove is closed by the cover. The two base housings are stacked together, with the protection walls mated together, and the contact portions are surrounded by these protection walls. Even when the connector is moved, for example, during the transport of the wire harness, an external force will not be applied to the contact portions, and the contact portions are protected.

In the third or fourth aspect of the present invention, by press-fitting the end of the wire into the press-connecting portion, the terminal is connected to the wire end. At this time, the contact portions are surrounded and protected by the cover, the protection wall and the band portions.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A connector comprising:

terminals each having a wire connection portion for connection to an end of a wire and a contact portion for connection to a mating terminal;

a base housing having, a body being receivable said terminals therein while said contact portions projects outwardly from said body, wire receiving grooves formed in stages in one end side of said body and receivable said wire connection portions of said terminals respectively, and a pair of covers closable the uppermost-stage and lowermost-stage wire receiving grooves, and each having a supporting portion which is pivotally connected to said body so as to be pivotally moved from the other end side of said body to their closed position; and band portions interconnecting said pair of covers which are disposed at the other end side of said body, wherein a protecting area for surrounding said contact portions of said terminals can be defined by said pair of covers and said band portions.

2. A connector according to claim 1, further comprising:

a housing case including, a tubular receiving portion for receiving said body, and a hood portion for surrounding said contact portions projecting from the other end of said body.

3. A connector according to claim 1, further comprising;

a housing case receivable said base housing and surroundable said contact portions.

4. A connector comprising:

terminals each having a wire connection portion for connection to an end of a wire and a contact portion for connection to a mating terminal, and a plurality of base housings which are stacked together, and receive said terminals therein, said contact portions projecting outwardly from bodies of said base housing;

wherein said base housing includes said body, a wire receiving groove which is formed in one end side of said body, and receives said wire connection portions of said terminals, and a cover which can close said wire receiving groove and has a supporting portion which is pivotally connected to said base housing so as to be pivotally moved from the other end side of said body to its closed position; and wherein a protecting area for surrounding said contact portions projecting from said body can be defined by said cover held at the other end side of said body, a protection wall extending from the other end side of said body, and band portions interconnecting the said protection wall and said cover.

5. The connector according to claim 4, in which said plurality of base housings comprising two base housings, wherein said wire receiving grooves are closed respectively by said covers after said band portions are cut off, and in this condition said two base housings are stacked together, with said wire receiving grooves facing each other, so that said protection walls of said two base housings are mated together.

6. A connector according to claim 5, in which a tubular portion is formed integrally on said protection wall of one of said two base housings, and when said protection walls are mated together, a hood portion is formed by said tubular portion and said two protection walls.

7. A connector according to claim 1, in which said wire connection portion of said terminal comprises a press-connecting portion having press-connecting blades, and the end of the wire is press-fitted into a gap between said press-connecting blades of said terminal received in said wire receiving groove in said body.

8. A connector according to claim 4, in which said wire connection portion of said terminal comprises a press-connecting portion having press-connecting blades, and the end of the wire is press-fitted into a gap between said press-connecting blades of said terminal received in said wire receiving groove in said body.

9. A method of assembling a connector including:

terminals each having a wire connection portion for connection to an end of a wire and a contact portion for connection to a mating terminal;

a base housing having, a body being receivable said terminals therein while said contact portions projects outwardly from said body, wire receiving grooves formed in stages in one end side of said body and receivable said wire connection portions of said terminals respectively, and a pair of covers closable the uppermost-stage and lowermost-stage wire receiving grooves, and each having a supporting portion which is pivotally connected to said body so as to be pivotally moved from the other end side of said body to their closed position;

band portions interconnecting said pair of covers which are disposed at the other end side of said body; and a housing case including a tubular receiving portion for receiving said body, and a hood portion for surrounding said contact portions projecting from the other end of said body;

wherein a protecting area for surrounding said contact portions of said terminals can be defined by said pair of covers and said band portions, said method comprising the following steps in the sequence set forth:

disposing said pair of covers of said base housing at the other end side of said body while said pair of covers are interconnected- by said band portions, and simultaneously opening said wire receiving grooves;

inserting each of said terminals into said base housing in such a manner that said wire connection portion is received in said wire receiving groove while said contact portion projects into the other end side of said body;

cutting off said band portions; and moving each of said covers pivotally from the one end side of said body to close said wire receiving grooves.

10. The method according to claim 9, further comprising the steps of:

inserting said base housing into said housing case, so that said body is received in said tubular receiving portion, while said contact portions is surrounded by said hood portion.

11. A method according to claim 9, wherein said wire connection portion of said terminal comprises a press-connecting portion having press-connecting blades, and said method further comprising the steps of:

press-fitting the end of the wire into a gap between said press-connecting blades of said terminal received in said wire receiving groove in said body.

12. A method of assembling a connector comprising:

terminals each having a wire connection portion for connection to an end of a wire and a contact portion for connection to a mating terminal, and a plurality of base housings which are stacked together, and receive said terminals therein, said contact portions projecting outwardly from bodies of said base housing;

wherein said base housing includes said body, a wire receiving groove which is formed in one end side of said body, and receives said wire connection portions of said terminals, and a cover which can close said wire receiving groove and has a supporting portion which is pivotally connected to said base housing so as to be pivotally moved from the other end side of said body to its closed position; and wherein a protecting area for surrounding said contact portions projecting from said body can be defined by said cover held at the other end side of said body, a protection wall extending from the other end side of said body, and band portions interconnecting the said protection wall and said cover, said method comprising the following steps in the sequence set forth:

disposing said cover of each of said base housings at the other end side of said body while said cover is connected to said protection wall by said band portions, and simultaneously opening said wire receiving groove;

inserting said terminal in the corresponding base housing in such a manner that said wire connection portions are received in said wire receiving groove while said contact portions projects into the other end side of said body;

cutting off said band portion;

moving said cover of each of said base housing pivotally from the one end side of said body to close said wire receiving groove.

13. The method according to claim 12, further comprising the steps of:

stacking said base housings together while said protection walls are being mated together.

14. A method according to claim 12, wherein said wire connection portion of said terminal comprises a press-connecting portion having press-connecting blades, and said method further comprising the steps of:

press-fitting the end of the wire into a gap between said press-connecting blades of said terminal received in said wire receiving groove in said body.

* * * * *